US005281170A

United States Patent [19]

Murphy

[11] Patent Number: 5,281,170

[45] Date of Patent: Jan. 25, 1994

[54] ROUND-TO-FLAT SHIELDED CONNECTOR ASSEMBLY

[75] Inventor: Paul Murphy, Des Plaines, Ill.

[73] Assignee: Molex Incorporated, Lisle, Ill.

[21] Appl. No.: 1,421

[22] Filed: Jan. 6, 1993

Related U.S. Application Data

[63] Continuation of Ser. No. 759,383, Sep. 13, 1991.

[51] Int. Cl.[5] ..... H01R 9/03

[52] U.S. Cl. ..... 439/610; 439/676; 439/469

[58] Field of Search ..... 439/99, 98, 607, 609, 439/610, 676, 608, 95, 108, 344, 469; 29/862

[56] References Cited

U.S. PATENT DOCUMENTS

| | | | |
|---|---|---|---|
| 4,577,920 | 3/1986 | Coldren et al. | 439/607 |
| 4,767,355 | 8/1988 | Phillipson et al. | 439/610 |
| 4,889,503 | 12/1989 | Phillipson et al. | 439/676 |
| 4,891,022 | 1/1990 | Chandler et al. | 439/610 |

*Primary Examiner*—Daniel W. Howell
*Assistant Examiner*—Hien D. Vu
*Attorney, Agent, or Firm*—A. A. Tirva

[57] ABSTRACT

A system is provided for producing a shielded connector assembly for connecting a round multiconductor cable to a complementary connector having a flat array of terminals. The cable includes a plurality of insulated conductors within a cable shield and surrounded by an outer insulating jacket which is stripped to expose the cable shield and the insulated conductors. An insulating housing has a receptacle for receiving the insulated conductors in a flat array. A plurality of terminals are provided for termination to the received conductors and for mating with the terminals of the complementary connector. A conductive connector shield is mounted on and about a portion of the insulating housing, with a portion of the shield extending into the receptacle. A round conductive crimp ferrule is positioned over the round multiconductor cable in engagement with the exposed cable shield and with the exposed insulated conductors projecting from an end of the crimp ferrule. The exposed insulated conductors are sorted and positioned in a flat array. The round conductive crimp ferrule is crimped into a generally flat configuration onto the cable for holding the conductors in their flat array within the receptacle of the housing for termination to the terminals, and with the crimped ferrule in engagement with the shield portion in the receptacle.

6 Claims, 4 Drawing Sheets

ROUND-TO-FLAT SHIELDED CONNECTOR ASSEMBLY

This is a continuation of copending application Ser. No. 07/759,383 filed on Sep. 13, 1991.

FIELD OF THE INVENTION

This invention generally relates to the art of electrical connectors and, particularly, to a system of providing a shielded connector assembly for connecting a round multiconductor cable to a complementary connector having a flat array of terminals.

BACKGROUND OF THE INVENTION

It is very common to mass terminate a plurality of insulated conductors to a connector. The conductors may be provided for mass termination in a variety of forms. In round conductor ribbon cable, for example, discrete wire conductors are disposed in a generally flat, parallel spaced relation to each other between insulating dielectric layers which surround and insulate the wires and form webs of insulation between them. Alternatively, conductors may be provided in the form of a multi-cable assembly having a plurality of insulated conductors surrounded by an outer insulation jacket of a generally round cross-section This latter type of cable assembly presents problems that are absent when dealing with round conductor ribbon cable. When using a ribbon cable, the intervening webs serve to maintain the relative position and spacing of adjacent conductors. On the other hand, when handling discrete wire, the insulated conductors first must be unravelled from a bundle of wires and thereafter positioned in such a manner to permit mass termination with a plurality of terminals.

An example of such a connector system is a telecommunication system wherein a modular unit, such as a telephone, may be provided with an external connector of the receptacle type having a row of laterally spaced terminals which are connected electrically to internal circuitry of the unit. Therefore, electrical connections may be made to the internal circuitry through a flat cable terminated in a modular telecommunication plug which is inserted into the receptacle type connector on the modular unit. The plug is provided with a row of laterally spaced terminals which electrically engage respective terminals in the receptacle type connector and are electrically connected to respective terminals in the flat cable. The flat cables provide means for avoiding any confusion as to which of the conductors in the cable is connected electrically to which of the terminals laterally spaced in the row. However, in some instances, it may be necessary to make electrical connections to internal circuitry of the modular unit through a round cable, such as a coiled cord. The round cable generally does not have the proper size or configuration for terminating in the modular plug suitable for insertion into the receptacle type connector on the unit. In addition, the conductors in the round cable are not disposed in predetermined side-by-side positional relationship for electrical connection to respective terminals in the row thereof.

In order to solve the round-to-flat problems described above, various electrical connector systems have been provided wherein adapters are incorporated in the connectors for positioning and retaining the discrete wires of a round cable in a flat array for termination to the flat array of terminals in a row in the respective connector. Examples of such connectors are shown in U.S. Pat. Nos. 4,713,023, dated Dec. 15, 1987, and 4,769,906, dated Dec. 13, 1988. The 4,713,023 patent is assigned to the assignee of the present invention and is incorporated herein by reference.

The present invention is directed to solving the problems of terminating a round cable in a flat terminal array connector in an extremely simple manner and eliminating the adaptor means of the prior art.

SUMMARY OF THE INVENTION

An object, therefore, of the invention is to provide a new and improved system of providing a shielded connector assembly for connecting a round cable to a connector having a flat array or row of terminals. The system includes a method of producing the connector as well as the connector itself.

In the system to which the invention is applied herein, the round cable includes a plurality of insulated conductors within a cable shield and drain wire and surrounded by an outer insulating jacket. The shielded connector assembly includes an insulating housing having receptacle means for receiving the insulated conductors in a flat array. A plurality of terminals are mounted in the housing for termination to the received conductors and for mating with the terminals of a complementary connector. A conductive connector shield means is mounted on and about a portion of the insulating housing, with a portion of the shield means extending into the receptacle means.

The invention contemplates a method of producing a shielded connector assembly with the above basic components, including the steps of stripping a portion of the insulating jacket from the multiconductor cable to expose the cable shield and the discrete insulated conductors. A round conductive crimp ferrule is placed over the round multiconductor cable in engagement with the exposed cable shield and with the exposed insulated conductors projecting from an end of the crimp ferrule. The exposed insulated conductors then are sorted and positioned in a flat array. The round conductive crimp ferrule is crimped onto the round cable into a flat configuration for holding the sorted end positioned conductors in the flat array. The cable then can be positioned in the insulating housing with the flat array of conductors in the receptacle means for termination to the terminals and with the crimped ferrule in engagement with the portion of the shield means extending into the receptacle means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
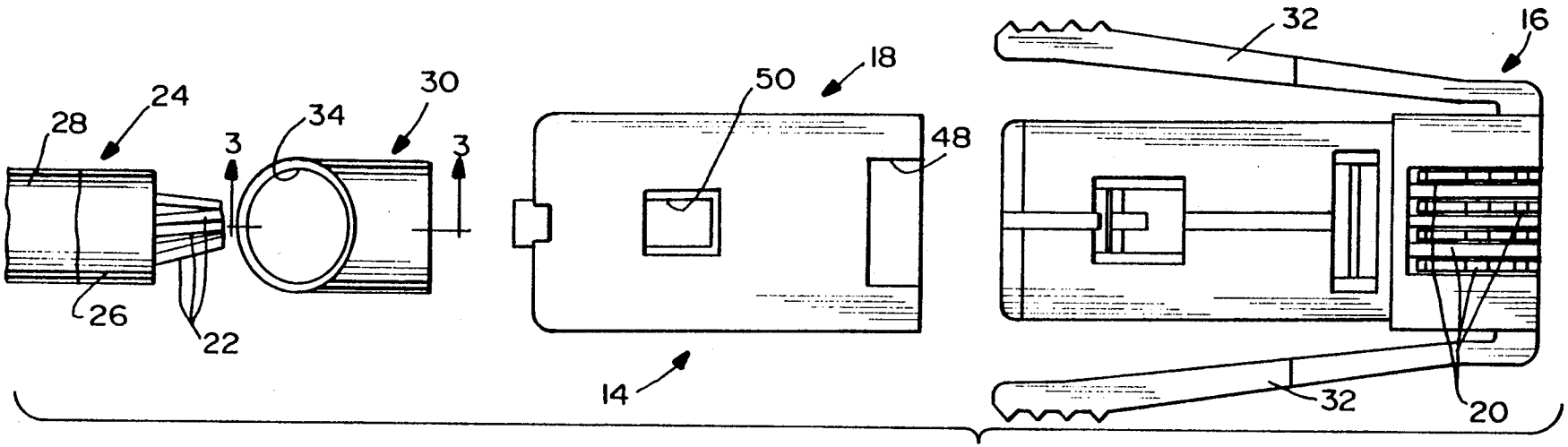
FIG. 1 is an exploded top plan view of the major components of a shielded connector assembly embodying the concepts of the invention.

Referring to the drawings in greater detail, and first to FIG. 1, the invention is embodied in a shielded electrical connector assembly, generally designated 14, which is in the form of a modular shielded plug connector assembly, such as might be used in the telecommunications industry. The plug assembly is shown generally to include a plug housing, generally designated 16, which mounts a grounding shield in the form of a unitary stamped and formed metallic shell, generally designated 18, around the rear area of housing 16, and a plurality of insulation piercing terminals 20 within the housing.

As will be seen in greater detail hereinafter, terminals 20 are adapted for termination to discrete insulated conductors 22 of a multiconductor electrical cable 24 which is shown in FIG. 1 to be stripped to expose the ends of insulated conductors 22 as well as a conductive metallic foil 26 which is shown turned back on itself over the outside surface of an insulating jacket 28 of the cable. Foil 26 acts as a shield for conductors 22 and insulating jacket 28 surrounds the foil. Of course, as is known, the foil may also comprise a braid or other ground system for the multiconductor cable and may also include a drain wire. Lastly, FIG. 1 shows a round crimp ferrule 30 of conductive material, such as metal or the like, which is to be crimped into a flat configuration about multiconductor cable 24, in conductive engagement with foil 26 and exposing conductors 22 for termination with terminals 20.

Figure 2:
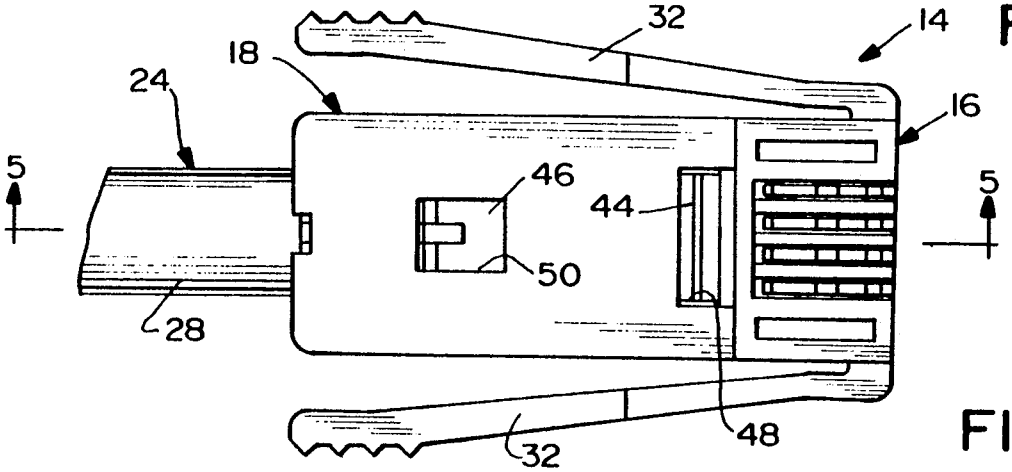
FIG. 2 is a top plan view of the assembled connector assembly.

FIG. 2 shows shielded plug connector assembly 14 in assembled condition, with grounding shield 18 around the rear of housing 16, and with multiconductor cable 24 projecting from the rear of the assembly. It can be seen that housing 16 of the connector assembly has a pair of latch arms 32 which extend laterally outwardly and rearwardly from opposite sides of the plug connector assembly for latching the plug connector assembly in mating engagement within a complementary receptacle connector assembly not shown) as disclosed in the 4,713,023 patent described above and incorporated herein by reference. Suffice it to say, housing 16, including latch arms 32, is a unitary structure of dielectric material, such as molded plastic or the like.

Figure 3:
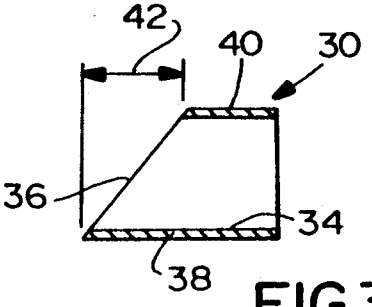
FIG. 3 is a vertical section taken generally along line 3—3 of FIG. 1, through the crimp ferrule of the invention.
Figure 4:
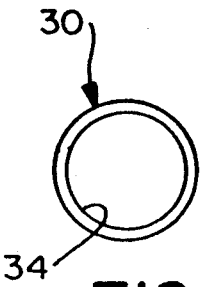
FIG. 4 is an end elevational view, looking toward the right-hand end of the crimp ferrule in FIG. 3.

FIGS. 3 and 4 show that crimp ferrule 30 is generally cylindrical to define a round through passage 34 sized to receive round multiconductor cable 24. As can be seen in FIG. 3, crimp ferrule 30 is cut at one end, as at 36, along an angle so that a bottom wall section 38 of the ferrule is longer than a top wall section 40. For purposes described hereinafter, the angled cut of the ferrule provides a clearance, as indicated by double-headed arrow 42, in a vertically downward direction to define access means from the top of the ferrule to the multiconductor cable extending through the ferrule.

Figure 5:
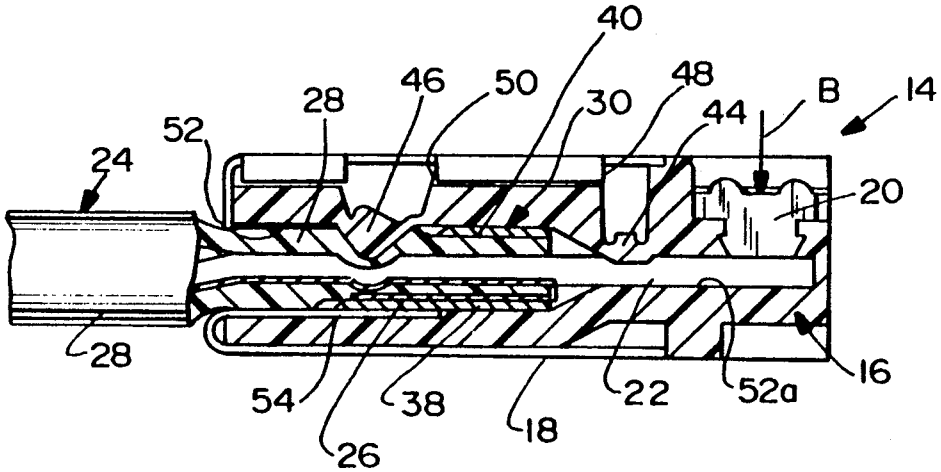
FIG. 5 is a vertical section, taken generally along line 5—5 of FIG. 2.

FIG. 5 shows plug connector assembly 14 in completely assembled condition. It can be seen that crimp ferrule 30 has been crimped into a flat configuration onto the stripped end of multiconductor cable 24 about the grounding foil 26, with conductors 22 projecting forwarding from an end of the ferrule and terminated to terminals 20 which have been forced downwardly in the direction of arrow "B" to pierce the insulation of the conductors and terminate the cores of the conductors. It also can be seen that housing 16 has strain relief sections 44 and 46 to which access is provided by openings 48 and 50, respectively, in shield 18 (also see FIG. 2). Again, reference can be made to the 4,713,023 patent for details of this arrangement. Suffice it to say, strain relief section 44 provides strain relief laterally across the plug assembly for all of conductors 22, and strain relief section 46 provides strain relief onto insulating jacket 28 of multiconductor cable 24.

Still referring to FIG. 5, it can be seen that housing 16 of plug assembly 14 has receptacle means in the form of an interior cavity 52 for receiving the cable, the receptacle means narrowing in a forward area 52*a* whereby conductors 22 are in a flat array for termination to the row of terminals 22 described in relation to FIG. 1. It also can be seen that shield 18 has a portion 54 bent back into receptacle means 52 along the bottom wall thereof. Shield portion 54 can be seen to be in vertical alignment with strain relief section 46. Therefore, with crimp ferrule 30 cut at an angle as described in relation to FIG. 3, the clearance 42 (FIG. 3) provides access means for strain relief section 46 to engage insulating jacket 28 of the cable while bottom wall section 38 of the crimp ferrule still is in engagement with shield portion 54. Therefore, ground continuity is established between shield 18, its portion 54, crimp ferrule 30 and ground foil 26 of the multiconductor cable.

The system of the invention contemplates using grounding crimp ferrule 30 as a means for positioning conductors 22 of round cable 28 in a flat array for termination to the row of terminals 20. In other words, it can be seen in FIGS. 1, 3 and 4 that crimp ferrule 30 initially is provided in a cylindrical configuration with its round through passage 34 sized to receive round cable 24. However, as seen in FIG. 5, the crimp ferrule is flattened considerably, after crimping, to maintain conductors 22 in a flat array for termination to the row of terminals 20.

Specifically, the invention contemplates a method of assembling connector 16, including the steps of stripping a portion of insulating jacket 28 (FIG. 1) from multiconductor cable 24 to expose the cable shield or foil 26 and the insulated conductors 22. Round crimp ferrule 30 then is placed about the round cable, with the vertically cut end of the ferrule generally in line with the stripped end of the insulating jacket of the cable, as seen in FIG. 5. Conductors 22 then are sorted in their proper circuit order and laid out in a flat array, being careful then is crimped onto the cable by a generally flat crimping tool to hold the conductors in their sorted and flat array. As will be seen hereinafter, this can be accomplished by placing the subassembly of the ferrule and cable, with the sorted conductors, in an anvil of an application tool, making sure that the top wall section 40 of the ferrule faces downwardly from the flat array of conductors. The crimped subassembly then can be positioned within interior cavity 52, and forward area 52*a* of plug connector housing 16, as described above, with the flat array of conductors in position for termination with terminals 20 and with the crimp ferrule 30 in engagement with shield portion 54. Appropriate application tooling then can be used to drive insulation piercing terminals 20 into conductors 22 and to force strain relief sections 44 and 46 of the housing into engagement with the conductors and the insulating jacket of the cable.

Figure 6:
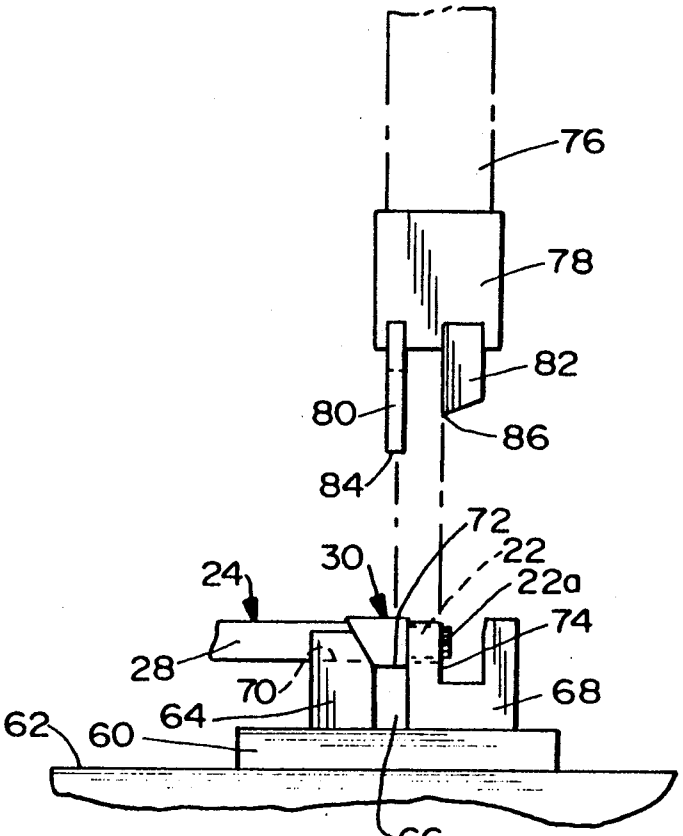
FIG. 6 is a somewhat schematic illustration of a press tool for crimping the round-to-flat crimp ferrule of the invention.

FIG. 6 simply shows one type of application tooling for crimping crimp ferrule 30 onto multiconductor cable 24. In particular, a tool may include a mounting base 60 for positioning on a support surface 62. A cable guide 64, a crimp anvil 66 and a cut off anvil 68 are fixed to the top of mounting base 60. Cable guide 64 has a trough 70 for positioning multiconductor cable 24. Crimp anvil 66 has a generally flat anvil surface 72 for engaging the bottom of crimp ferrule 30. Cut off anvil 68 has a cutting surface 74 for trimming ends 22*a* from conductors 22. In actual practice, the insulating jacket 28 of cable 24 is stripped slightly greater than the length of the conductors 22 to be positioned within the plug assembly housing so that excess ends 22*a* can be removed to provide a consistent length of the exposed conductors to be positioned within the plug housing.

Still referring to FIG. 6, the application tooling may include a press ram 76 having a tool holder 78 for mounting a crimp punch 80 and a cutoff blade 82. The crimp punch has a distal end 84 shaped and sized to contain the ferrule 30 and to control its width for crimping onto the bottom of crimp ferrule 30, opposite flat surface 72 of crimp anvil 66 to flatten the crimp ferrule and maintain the flat sorted array of the conductors. Cut off blade 82 has a cutting edge 86 for cutting-off the ends 22*a* of conductors 22.

Figure 7:
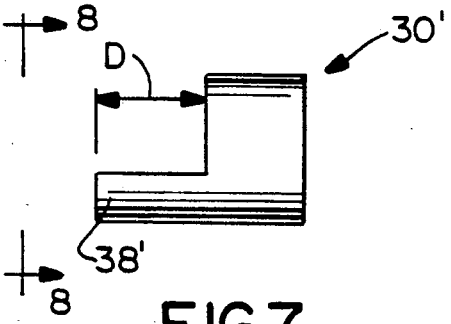
FIGS. 7 and 8 are side and end elevational views, respectively, of an alternate form of crimp ferrule according to the invention.
Figure 8:
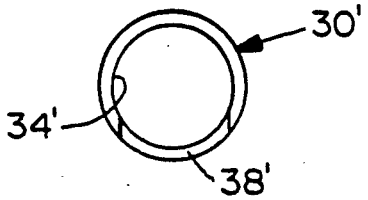

FIGS. 7–14 show alternate forms of crimp ferrules for carrying out the concepts of the invention. In each instance, the ferrule has a generally round through passage, similar to through passage 34 of crimp ferrule 30, for positioning over round cable 24 in engagement with its grounding means, such as foil 26. More particularly, FIGS. 7 and 8 show a round crimp ferrule 30′ having a through passage 34′. The crimp ferrule is generally cylindrical except for a lower wall section 38′ which projects outwardly from the main portion of the ferrule. In other words, a clearance is provided, as indicated by double-headed arrow "D", sufficient for strain relief section 46 (FIG. 5) to engage the insulating jacket of the cable, while projecting wall section 38′ of the crimp ferrule is maintained in engagement with shield portion 54.

Figure 9:
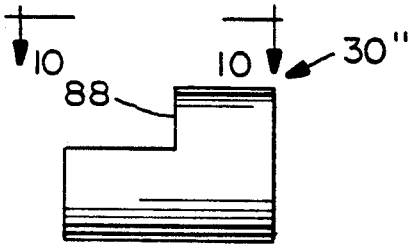
FIGS. 9 and 10 are side and end elevational views, respectively, of a further form of crimp ferrule according to the invention.
Figure 10:
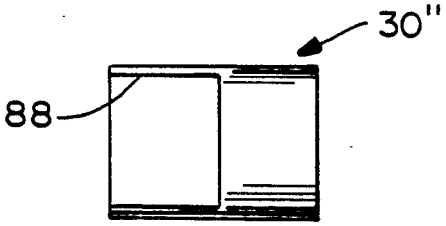

FIGS. 9 and 10 show a further embodiment of a crimp ferrule 30″ which is substantially cylindrical but which is provided with a cutout 88 in the top of the ferrule to provide access through the cutout by strain relief section 46 of the plug connector housing, while the bottom of cylindrical crimp ferrule 30″ is maintained in engagement with shield portion 54.

Figure 11:
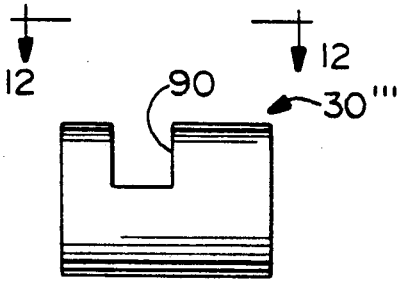
FIGS. 11 and 12 are side and end elevational views, respectively, of a further another form of crimp ferrule according to the invention.
Figure 12:
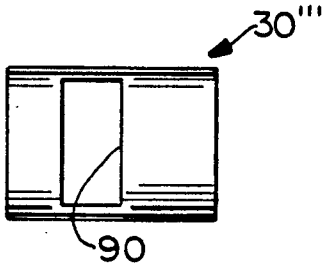

FIGS. 11 and 12 show a further modification wherein a crimp ferrule 3041 ′ is generally cylindrical and is provided with a window 90 in the top thereof. The window provides access means through which strain relief section 46 can be moved into engagement with the insulating jacket of the cable, while the bottom of crimp ferrule 30‴ is maintained in grounding engagement with shield portion 54.

Figure 13:
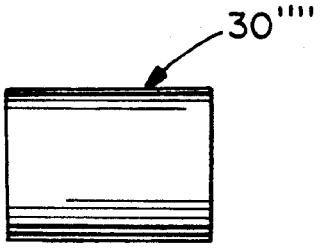
FIGS. 13 and 14 are side and end elevational views, respectively of still another form of a crimp ferrule according to the invention.
Figure 14:
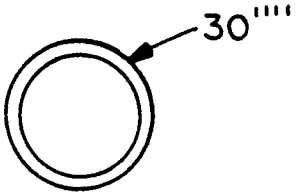

FIGS. 13 and 14 show a further embodiment of a crimp ferrule 30⁗ which is simply a length of generally round conductive tubing without any access means allowing the strain relief section 46 to directly engage the insulating jacket 28 of the cable 24.

Figure 15:
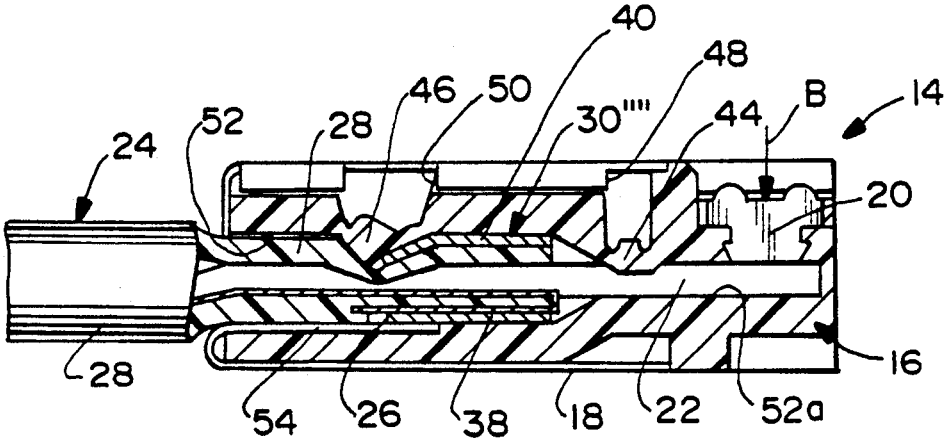
FIG. 15 is a vertical section, taken generally along line 5—5 of FIG. 2 and is similar to FIG. 5 except that the crimp ferrule in the assembly is as depicted in FIGS. 13 and 14.

Referring to FIG. 15 which is similar to FIG. 5, except that the full round ferrule 30⁗ is used to align and hold the individual conductors 22 instead of the cut-off ferrule 30 depicted in FIG. 5, the strain relief section 46 is adapted to engage an end portion of the ferrule 30⁗ opposite to the end from which the conductors 24 exit. Sufficient force is applied to the strain relief section 46 such that the portion of the ferrule 30⁗ engaged by the section 46 is deformed and the section 46 cold flows around the edge of the ferrule 30⁗ locking the ferrule 30⁗ in place in the plug assembly 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of producing a shielded connector assembly for connecting a round multiconductor cable to a complementary connector having a flat array of terminals, the round multiconductor cable including a plurality of insulated conductors within a cable shield and surrounded by an outer insulating jacket, and the shielded connector assembly including an insulating housing having receptacle means for receiving free ends of the insulated conductors positioned in a flat array, a plurality of terminals for termination to the received conductors and for mating with the terminals of the complementary connector, a conductive connector shield means mounted on and about at least a portion of the insulating housing with a portion of the shield means extending into the receptacle means, and strain relief means located generally opposite said portion of the shield means, the method comprising the steps of:

stripping a portion of the insulating jacket from the cable to expose the cable shield;

turning the cable shield back upon itself over the insulating jacket to expose the free ends of the insulated conductors;

placing a round conductive crimp ferrule over the round multiconductor cable in engagement with the exposed cable shield and with the exposed free ends of the insulated conductors projecting from an end of the crimp ferrule;

positioning the exposed free ends of the insulated conductors in a flat array wherein the conductors are located adjacent to and substantially parallel to each other;

crimping the round conductive crimp ferrule into a flat configuration onto the cable as the sole means for holding the exposed free ends of the conductors in said flat array prior to insertion of said conductors into said insulated housing;

positioning the cable in the insulating housing with the flat array of the free ends of the conductors extending from the ferrule into the receptacle means and holding the free ends of the conductors in the flat array for termination to the terminals and with the crimped ferrule in engagement with said portion of the shield means; and forcing said strain relief means into engagement with the ferrule.

2. The method of claim 1, wherein the step of forcing said strain relief means into engagement with the ferrule includes deforming a portion of one end of the ferrule to maintain the crimp ferrule in engagement with said portion of the means.

3. The method of claim 2, wherein said step of forcing said strain relief means into engagement with the ferrule further includes allowing the strain relief means to cold flow around the deformed end portion of the ferrule locking the ferrule into the housing.

4. A shielded connector assembly for connecting a round multiconductor cable to a complementary connector having a flat array of terminals, the round multiconductor cable including a plurality of insulated conductors within a cable shield and surrounded by an outer insulating jacket which is stripped from the cable to expose the cable shield and the cable shield is turned back upon itself over the outer insulating jacket to expose free ends of the insulated conductors, comprising:

an insulating housing having receptacle means for receiving the free ends of the insulated conductors positioned in a flat array, a plurality of terminals for termination to the received conductors and for mating with the terminals of the complementary connector, and a conductive connector shield means mounted on and about at least a portion of the insulating housing with a portion of the shield means extending into the receptacle means;

said housing includes strain relief means for the cable at a location generally opposite a portion of the shield means in the receptacle means;

a round conductive crimp ferrule configured to be placed over the round conductor cable in engagement with the exposed cable shield and with the exposed free ends of the insulated conductors projecting from a first end of the crimp ferrule, the crimp ferrule configured to be crimped into a flat configuration onto the cable as the sole means for holding the free ends of the conductors in a generally flat array in the receptacle means of the housing for termination to the terminals of the connector assembly; and said strain relief means engages said insulating jacket of the cable and a portion of the ferrule adjacent a second end opposite from the first end from which the free ends of the conductors extend to maintain the ferrule in engagement with said portion of the shield means.

5. A shielded connector assembly of claim 4, wherein said strain relief means is of a plastic material which is deformed while the strain relief means engages the ferrule such that the strain relief means is in contact with the ferrule and the multiconductor cable.

6. A shielded connector assembly of claim 5, wherein a portion of the strain relief means is positioned behind the second end of the ferrule whereby the ferrule is locked in the housing.

* * * * *